United States Patent [19]

Kuhn

[11] 3,982,714

[45] Sept. 28, 1976

[54] PROPORTIONAL LEAD GUIDANCE

[76] Inventor: Harland L. Kuhn, 4611 Raymar Drive, Orlando, Fla. 32809

[22] Filed: July 24, 1972

[21] Appl. No.: 274,683

Related U.S. Application Data

[63] Continuation-in-part of Ser. No. 828,804, May 26, 1969, abandoned.

[52] U.S. Cl. ..... 244/3.16

[51] Int. Cl.[2] ..... F41G 7/00

[58] Field of Search ..... 244/3.15, 3.16, 3.17, 244/3.18; 343/5

[56] References Cited

UNITED STATES PATENTS

| | | | |
|---|---|---|---|
| 2,109,475 | 3/1938 | Fanning | 244/3.15 |
| 2,963,973 | 12/1960 | Estey | 244/3.16 |
| 2,969,018 | 1/1961 | Erst et al. | 244/3.16 |
| 2,997,594 | 8/1961 | MacNeille | 244/3.16 |
| 3,020,537 | 2/1962 | Schriefer | 244/3.19 |
| 3,128,061 | 4/1964 | Chew | 244/3.16 |
| 3,351,303 | 11/1967 | DePew, Jr. et al. | 244/3.16 |

*Primary Examiner*—Samuel Feinberg

[57] ABSTRACT

A guidance system for a missile or other vehicle utilizing a gyro stabilized seeker which is arranged in such a manner with respect to the missile as not to be servo controlled, but rather to follow the missile air-frame by means of passive coupling between seeker and airframe, as the airframe is steered to turn in response to seeker error signals. As a result of this arrangement the missile velocity vector is steered to point toward fixed targets or to lead moving targets. A further result of this arrangement is that the servo loop used to point the seeker toward the target in the conventional arrangement is not required and accordingly my missile guidance arrangement can achieve greater accuracy with less complexity than in the prior art.

26 Claims, 9 Drawing Figures

INVENTOR
HARLAND L. KUHN
BY Julian C. Renfro
ATTORNEY

INVENTOR

HARLAND L. KUHN

BY Julian E. Renfro

ATTORNEY

INVENTOR

HARLAND L. KUHN

BY Julian C. Renfro

ATTORNEY

INVENTOR
HARLAND L. KUHN
BY Julian C. Renfro
ATTORNEY

A-A

INVENTOR
HARLAND L. KUHN

BY Julian C. Renfro
ATTORNEY

INVENTOR
HARLAND L. KUHN

BY Julian C. Renfro
ATTORNEY

INVENTOR
HARLAND L. KUHN

BY Julian C. Renfro
ATTORNEY

PROPORTIONAL LEAD GUIDANCE

CROSS-REFERENCE TO RELATED INVENTION

The present invention is a Continuation-in-Part of the application of Harland L. Kuhn entitled "Proportional Lead Guidance," filed May 26, 1969, Ser. No. 828,804, abandoned.

This invention relates to a missile guidance system, hereinafter referred to as proportional lead guidance, that may utilize a gyro mounted spinning mirror arrangement that is designed to reflect electromagnetic energy from a target onto a quadrant cell arrangement or the like so as to indicate the error between a line normal to the surface of the spinning mirror and the line of sight to the source of the radiated energy. As a result of this arrangement, an error signal is generated which is suitably amplified and ultimately used to control surfaces of the missile in such a way that the missile will be caused to impact upon the source of the electromagnetic energy, i.e. the target.

It is of course well known in the prior art to utilize missile guidance arrangements fitting this general description, but the usual arrangement involves a seeker which is steered with respect to the airframe to null the error between the seeker boresight and the line of sight to the target. In the present invention no such servo loop to steer the seeker is required, thus resulting in a considerable saving in complexity and a reduction in the number of error sources. In my proportional lead guidance arrangement, the seeker is steered in a manner to follow the general direction of the missile flight path. This is performed by lightly coupling the seeker to the airframe, using passive coupling means.

The coupling between the inertially stabilized seeker and the air-frame will be such that the inertially stabilized seeker will rotate to align itself with the airframe at a rate which is proportional to the displacement between the seeker boresight line and the centerline of the airframe. The strength of this coupling can be related to a time constant where this time constant represents the ratio of angular displacement to resulting seeker rotation rate.

In the preferred embodiment, the coupling between airframe and seeker is accomplished by enclosing the spinning rotor which in itself is a two pole magnet, in a passive processing coil closed through a series resistance, the coil receiving energy from the spinning rotor itself. The precessing coil and series resistance function to apply a torque to the gyro which is proportional to the angle between the missile airframe axis and the seeker spin axis. As a result of this arrangement, the seeker generally follows the target, but in case of a moving target, the seeker lags behind the airframe by an angle substantially equal to the product of the velocity vector rotation rate and a time constant which is a function of the seeker to airframe coupling.

Thus, by steering the missile in the direction of the indicated error in the seeker, the missile velocity vector is directed toward the source of radiated energy and the seeker error is reduced. The result of this arrangement is a flight control system which senses and responds to the error between the velocity vector of the missile and the line of sight to the target. The invention is primarily concerned with the guidance of missiles designed to attack fixed targets from an airborne launching platform, or targets whose motion is slow compared to the velocity of the missile. When a target being attacked by a proportional lead guidance directed missile moves in a direction normal to the line of sight from missile to target, the resulting error induced in the seeker will cause the missile to steer itself to bring the missile velocity vector to bear on the target. As the target continues to move, the missile will steer itself in a direction to reduce the seeker error, this causing the missile velocity to lead the line to signt to the target as the seeker boresight approaches the line of sight to the target. The amount of lead generated by this situation is proportional to the rotation rate of the line of sight to the target and hence the name "Proportional Lead Guidance".

In a crosswind, the missile flight path will be forced away from the target with a resulting effect similar to that of the moving normal to line of sight. When the situation occurs, the flight of the proportional lead guidance steered missile will again be forced to lead the target, thus in some manner compensating for the deleterious effect of the crosswind on the missile accuracy. This is brought about because as the missile is blown downwind an error is generated in the seeker which steers the missile upwind to cause the seeker boresight to bear on a location approaching the target. This in part compensates for the wind induced flight path error.

In the class of missiles using Proportional Lead Guidance steering, the velocity vector of the missile is assumed to lag behind the centerline of the airframe by an angle which is normally referred to as the "missile angle of attack". For proper operation of proportional lead guidance steering, the PLG seeking should lag behind the missile airframe by an angle which is greater than the angle of attack. This results in the velocity vector of the missile being directed ahead of the target in situations where the missile must fly a curved path to come to bear on the target. The lag or hand off angle between the missile airframe and the seeker boresight can be reduced when proportional lead guidance is used to steer a wing-controlled missile where the missile airframe essentially streamlines along the missile velocity vector and body angle of attack is not used to steer the missile.

The more usual configuration of air-to-surface missile which would employ a steering system in the nature of my proportional lead guidance would be a missile which depends on angle of attack for accelerations normal to the flight path. As a result of the seeker-airframe relationship in accordance with this invention in which precision torquing circuits are used to precess the gyro seeker, transient disturbances of the missile airframe and short period oscillations advantageously have little or no effect on the point direction of the seeker. This is because the very small coupling between airframe and seeker results in an infinitesimal movement of the seeker in the small time period over which any one such displacement of the airframe would occur.

In the conventional proportional navigation proportional navigation guidance, known as PNG, the seeker is steered or precessed by its own servo loop to track the target. If the target is moving, the seeker will lag behind the target by an amount necessary to generate an error sufficient to precess the seeker at a rate which will keep up with, but just behind the target. This error is therefore proportional to the line of sight turn rate of the target and is used to steer the missile in the PNG mode, where the steering command or the rotation rate of the missile velocity vector is required to be proportional to and several times larger than the line of sight rotation. As a result of this prior art arrangement, it is impossible for the missile steering system to differentiate between the hang-off error which indicates the line of sight turn rate, and any servo error in the PNG seeker tracking system. This is a prime disadvantage of the prior art and most significantly, is not a characteristic of my proportional lead guidance invention.

It should be noted that in the class of missiles upon which proportional lead guidance could be used, body angle of attack is normally employed to respond to steering commands. This results in a missile velocity vector differing from the missile attitude vector; i.e. the direction of the center line of the missile by some angle which is referred to normally as the angle of attack. To steer a missile in a certain direction, then it is necessary to steer the body of the missile in a slightly different direction. A useful technique for steering such as missile would be to have a device on board the missile which would sense the actual direction of the missile flight path and then steer the missile to follow the flight path in the desired direction.

Proportional lead guidance uses the seeker to not only track the target, but also to, in some way, sense the direction of the missile velocity vector. Therefore, steering the missile so that the proportional lead guidance seeker points toward the target results in steering the missile toward the target. The relationship between missile centerline and missile velocity vector is the angle of attack which is proportional to the rotation rate of the velocity vector of the missile. The relationship between the missile centerline and the seeker boresight is also proportional to the rotation rate of the centerline of the missile airframe. Therefore, as the missile turns, the seeker will fall behind or lag behind the airframe by an amount which can be either equal to, greater than, or less than the missile angle of attack.

If the amount of lag is greater than the amplitude of the angle of attack, then the missile velocity vector must continually lead the line of sight if the error between the line of sight and the centerline of the seeker is to be reduced in a turning situation. Therefore, I have placed on board the missile, a sensor which not only senses the direction of the target, but sets up a direct relationship between the direction of the target and the direction of the velocity vector of the missile.

A seeker in accordance with a preferred embodiment of my invention is arranged to sense the presence of electromagnetic energy and the direction of the source of such electromagnetic energy, and principally comprises a housing, an inertially stabilized element operatively mounted in said housing, and passive coupling means for controlling the positioning of the inertially stabilized element with respect to the housing. Means are provided for receiving incoming electromagnetic radiation when the axis of the housing is disposed in a pre-established direction with respect to the source, and means are disposed on the inertially stabilized element for directing electromagnetic energy arriving from such source onto detector means. Signal processing circuitry is arranged to receive energy from the detector means, and to convert it into the required directional information necessary for moving the direction of travel of such vehicle and consequently the axis of the housing in the direction of such source of electromagnetic energy. Significantly, the coupling means functions to cause the inertially stabilized element to tend to move to orient itself in a preferred direction with respect to the housing, such motion of the inertially stabilized element taking place at a rate proportional to the displacement angle between the axis of the element and the housing axis.

It is therefore a primary object of this invention to provide a vehicle guidance system based upon a novel guidance law.

It is another object of this invention to provide a guidance system for a missile, glide bomb, or other vehicle characterized by its comparative simplicity and accuracy.

It is yet another object of this invention to provide a missile guidance system in which the flight path of the missile will be caused to lead a moving target, thus in some manner compensating for the undesirable effects of target motion.

It is still another object to provide a guidance arrangement for a missile, glide bomb, or other vehicle utilizing an inertially stabilized seeker which not only senses the direction of the target, but also sets up a direct relationship between the direction the target and the direction of the velocity vector of the missile.

It is a yet further object to provide an inertially stabilized seeker which is coupled to the airframe in such a way that the seeker will rotate to align itself with the airframe at a rate which is proportional to the displacement between the seeker boresight line and the centerline of the airframe.

These and other objects, features and advantages will be more apparent from a study of the appended drawings in which:

FIG. 6 is a view to a larger scale of the rotor and gyro base, this also being a side elevational view in section to reveal internal detail;

DETAILED DESCRIPTION

Figure 1:
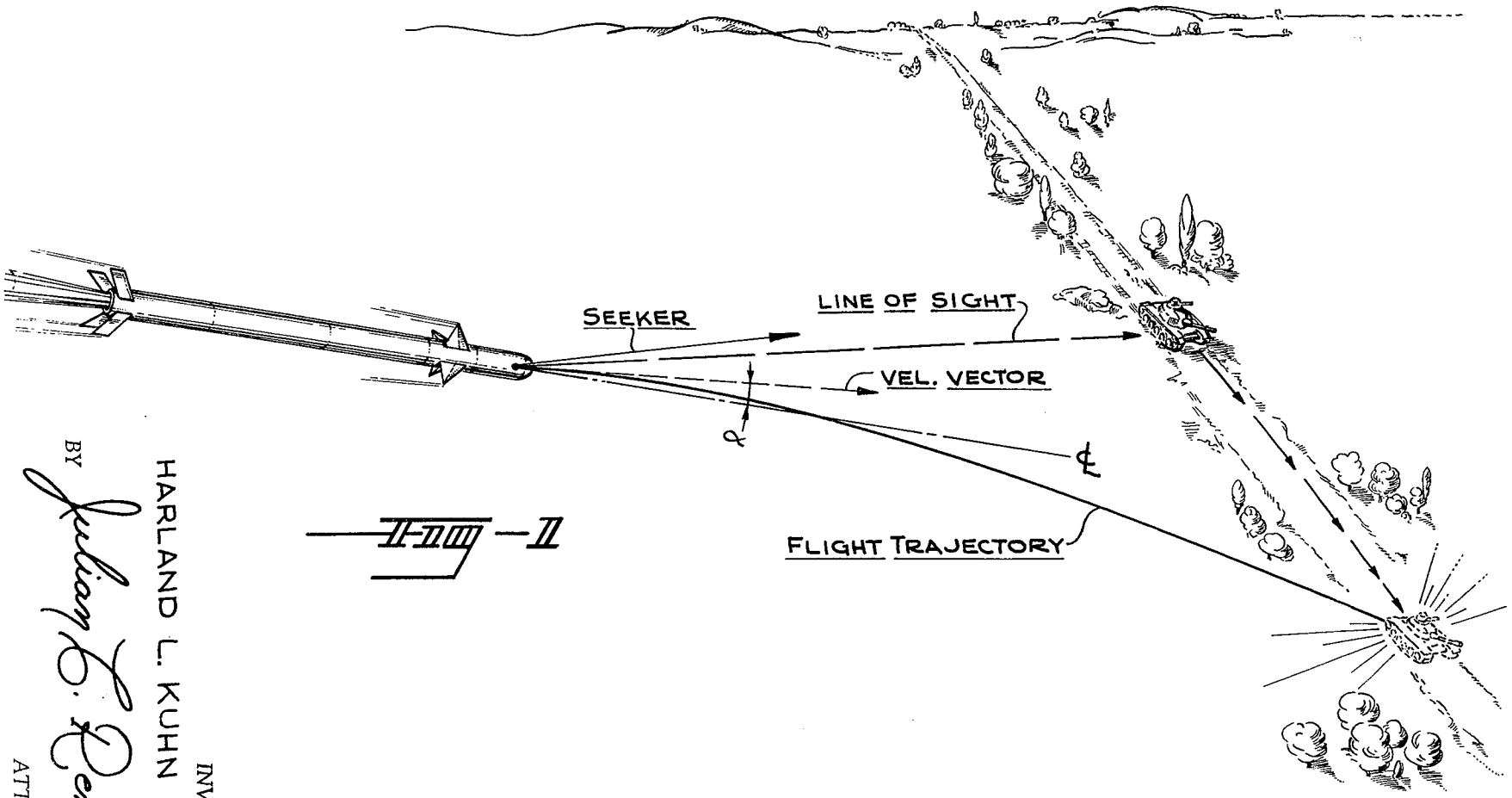
FIG. 1 is a perspective view of a vehicle-target relationship in which the missile velocity vector, seeker boresight axis, and other relationships are set forth diagrammatically.

FIG. 1 in effect represents an instantaneous view of a missile traveling along a slight trajectory to a moving ground target, such as a tank. At this particular moment, the centerline of the missile and the missile velocity are leading the target, that is, it is pointing along the projected target at a location ahead of the target. The seeker is pointed at a location on the target track behind the target. The error between the line of sight to the target and the boresight line of the seeker results in a steering command which functions to cause the missile to continue to turn toward a location ahead of the target up until final impact.

This missile would normally have been launched from an aircraft by a pilot who, after observing a target, was made aware that the seeker in the nose of the missile was pointed toward the target, and that the target was in the seeker's field of view. The missile steering commands will be proportional to the error between the line of sight to the target and the seeker boresight axis, as previously mentioned. In other words, the greater the displacement between the line of sight and the seeker, the greater the steering command up to and including an angular displacement of plus or minus one degree. For annular errors between one degree and seven degrees, a constant steering command is generated. The steering command of the missile is such that the velocity vector turn rate is kept at an annular rate several times the magnitude of the seeker to boresight angular error. In the preferred embodiment this is about six radians per second per radian of angular error. The steering command is transmitted through the missile actuation system and displaces the steering fins, causing the missile to turn in a direction to nullify the error between seeker and line of sight. For stationary targets a situation is soon arrived at where the seeker airframe boresight and velocity vector are all coincident, with the missile flying directly toward the target and no errors generated. However, for the moving target, the target will continually move in the field of view of the seeker, generating a continuing error which generates a steering command, which in turn results in a curved flight path results in a continual rotation of the missile centerline, which causes the missile to lead the seeker, and thus the missile centerline is always pointed in the direction ahead of the seeker boresight.

The continuous turning of the missile must be generated by an angle of attack $\alpha$ between missile velocity and missile centerline. Then, by the previously explained relationships between missile velocity vector turn rate and angle of attack on the one hand, and missile airframe turn rate and seeker displacement from the missile centerline on the other hand, the velocity must lead the target if the seeker boresight is to be kept close to the line of sight or to be continually approaching the line of sight.

Figure 2:
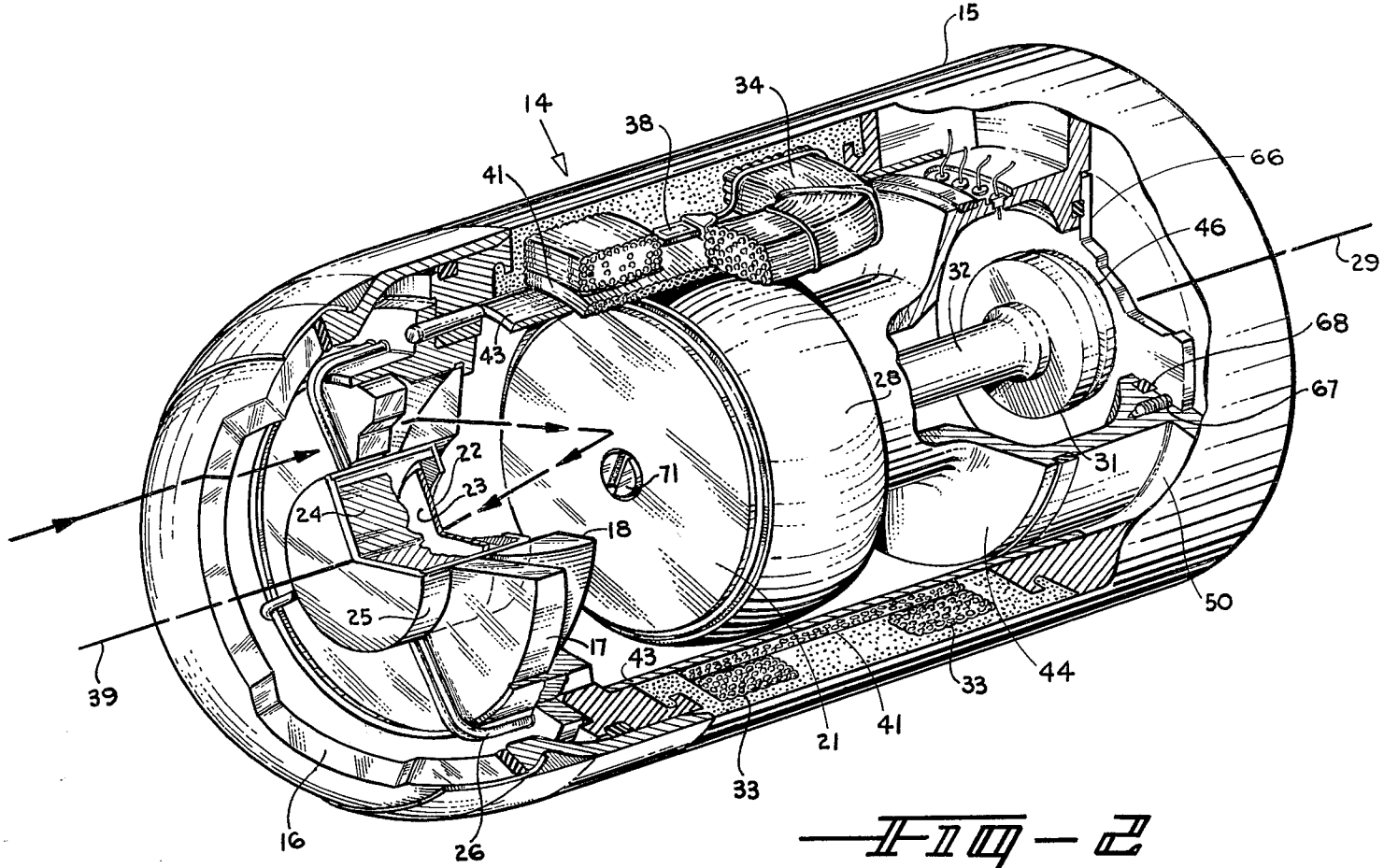
FIG. 2 is a perspective view of a seeker in accordance with a preferred embodiment of this invention, with certain portions broken away to reveal internal construction.

Turning to FIG. 2, it will be noted that in accordance with a preferred embodiment of my invention, I have shown a seeker assembly 14, which is normally found in the forwardmost part of the missile. The seeker assembly is contained in a housing 15 of generally cylindrical configuration. The front portion of the housing utilizes a transparent dome 16, through which illumination reflected from the target may pass. Electromagnetic energy in the form of light passing through the dome 16 then passes through an optical filter 17, which has a bandpass consonant with laser illuminator frequency. From the filter, the light passes through a fixed lens 18, which serves to focus the incoming light upon rotating mirror surface 21 in such a way that it then falls upon the sensitive portion 22 of a detector cell 23, such as a quadrant cell. The cell 23 serves to convert the light energy into an electrical current which is amplified by a preamplifier 24, such as may be contained in the detector housing 25. Suitable wires 26 conduct the amplified signal to a signal processing circuit at a remote location in the missile, which processes the signal in such a way as to evolve steering commands which are in accordance with proportional lead guidance steering laws. These commands are then transmitted to the control surfaces of the vehicle.

The mirror surface 21 is a flat disposed upon the front of inertially stabilized element 28, which in itself is a two degree of freedom gyroscope whose spin axis 29 is gimballed in pitch and yaw. The element or rotor 28 is fixed upon a rotary support shaft 32, and upon a rear portion of this shaft is attached a nutation damper 31. The rotor, support shaft and nutation damper in effect comprises a rigid body which rotates at say 6000 RPM.

Figure 3:
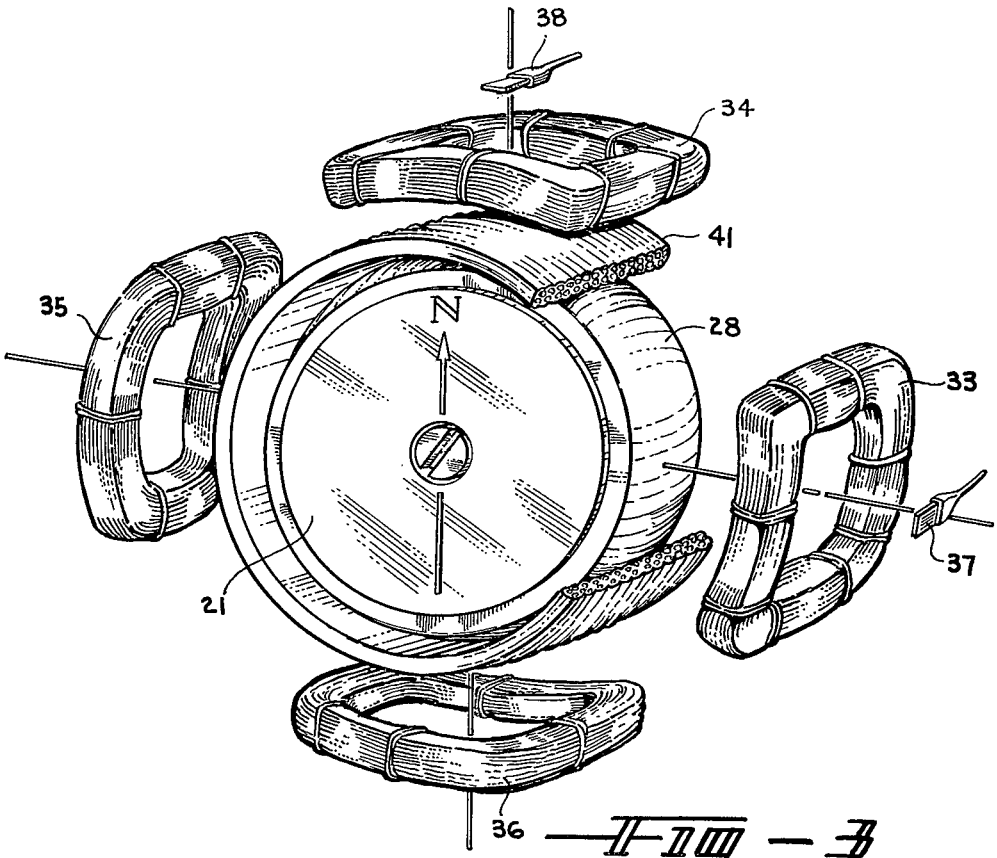
FIG. 3 is a fragmentary perspective view revealing a typical rotor-coil configuration, but with the coils shown in exploded relation.
Figure 4:
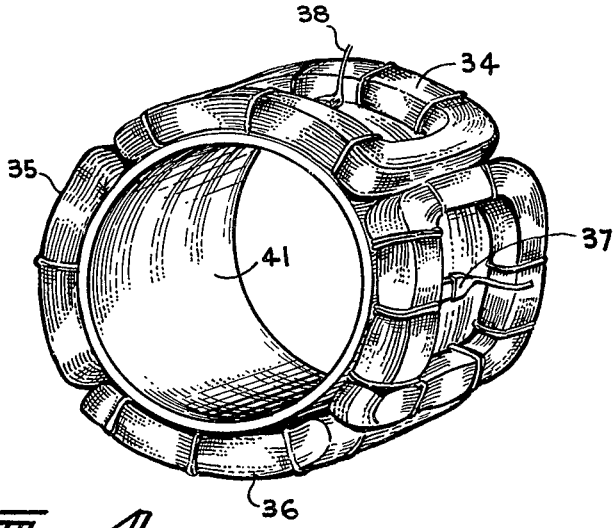
FIG. 4 shows the coils of FIG. 3 in non-exploded relation.

The rotor 28 is transversely polarized permanent magnet and with the four field coils 33 through 36 (best seen in FIGS. 3 and 4), and the two Hall effect devices 37 and 38 together comprise a two pole synchronous motor. The driving current supplied by the spin driving circuitry to the pair of coils 33 and 35, and to the pair of coils 34 and 36, serves to bring the rotor up to operating speed. The rotor drive currents supplied to the motor field coils are synchronized with the magnet rotation position by means of signals from the Hall effect devices 37 and 38, which devices are disposed in coils 33 and 34, respectively. The circuitry associated with these components will be discussed hereinafter.

Figure 5:
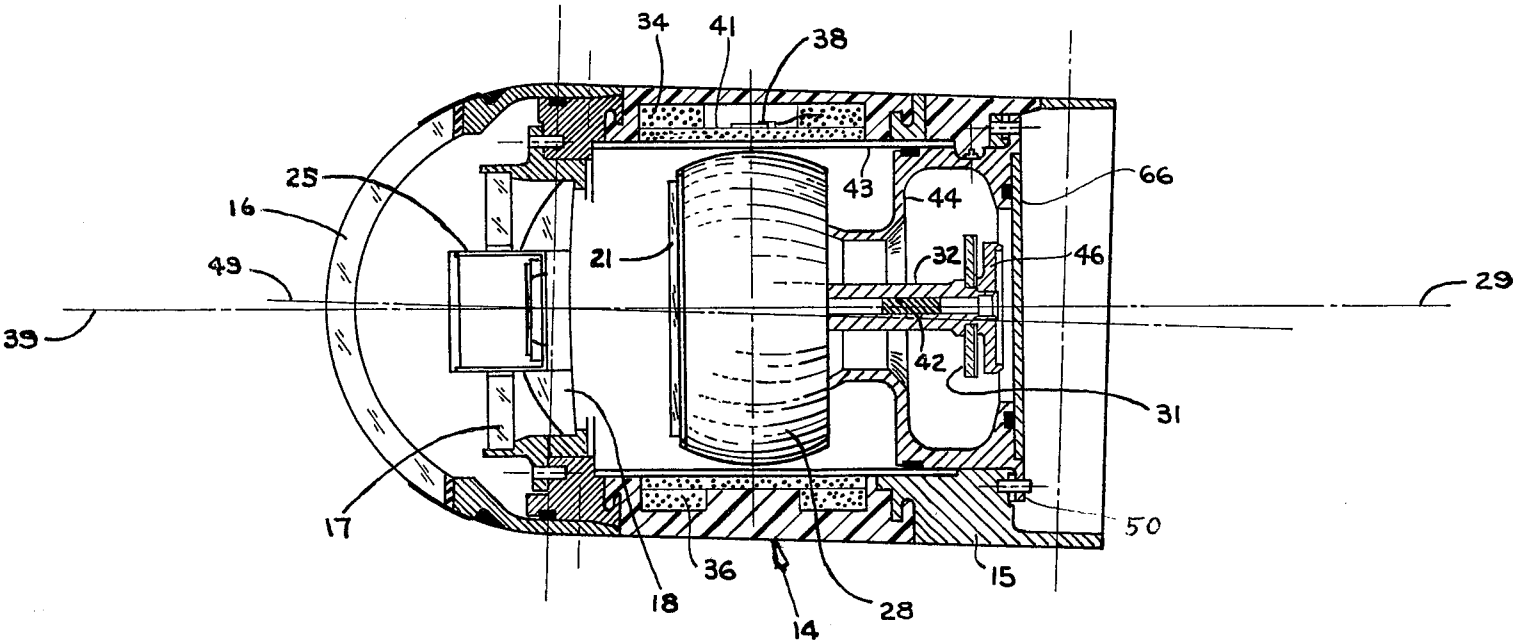
FIG. 5 is a side elevational view of the seeker housing, presented in section to reveal internal detail.
Figure 5:
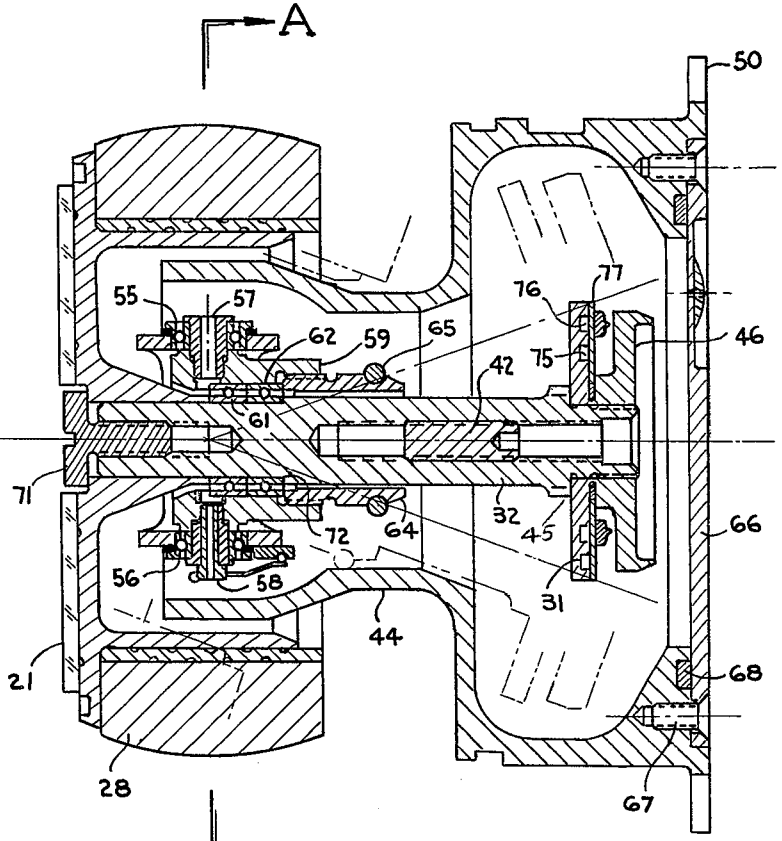

As is visible in all of the figures mentioned this far, a stationary precessing coil 41, also referred to as a coupling means, is disposed between the rotor and the field coils. FIG. 5 reveals that coil 41 is wound coaxially with the centerline 39 of the filter, lens, and rotor gimbal system, which line is canted somewhat with respect to the centerline 49 of the housing 15. The optical and coil axis 39 is canted with respect to the housing axis to provide a gravity bias for the missile. From this arrangement the preferred position of the seeker spin axis is below the housing axis 49 (which will also be the missile axis) by an amount equal to the angle of attack necessary to counter the effect of gravity on the missile.

Coil 4 is a passive torquing device which produces a torque of a magnitude and orientation to process the rotor toward the optical and coil axis 39 when the spin axis 29 is not aligned with this coil axis. The coil 41 may be disposed upon a coil form 43, with it being understood that these various electrical components including the coils 33 through 36 may be potted together to form an integral coil unit.

FIG. 5 also reveals that rotor 28 and the components rotatable therewith are supported from a member 44 known as a gyro base, with a circular flange 50 being disposed upon the rearmost portion of member 44 so that this member may be secured by screws or the like around the inner rear portion of the seeker housing 15. Shaft 32 is revealed to be hollow, and to have a weight 42 movably disposed in its interior. This weight is threaded and threadedly engages the interior of shaft 32. The end of the weight remote from the rotor is equipped with an Allen wrench fitting or the like. Rotation of this weight enables longitudinal adjustments of static balance so that proper rotative characteristics of the rotor can be obtained.

The nutation damper 31 is held in place against a shoulder 45 on the shaft 32 by a damper nut 46, which is threadedly received on the end of the support shaft 32; note FIG. 6. Circular slots 75 and 76 are provided in nutation damper 31 and in these slots may be disposed fluid mercury of a quantity not sufficient to fill the slots. This mercury is retained in these slots by a cover 77 held in place by suitable screws or the like. As will be well known to those versed in this art, the mercury is normally distributed evenly about these slots during normal rotation of the device, but in the event of nutational movement, the mercury will collect in the slots in such a manner as to extract energy from the undesirable nutation mode, and thus damp out the undesirable motion.

Figure 7:
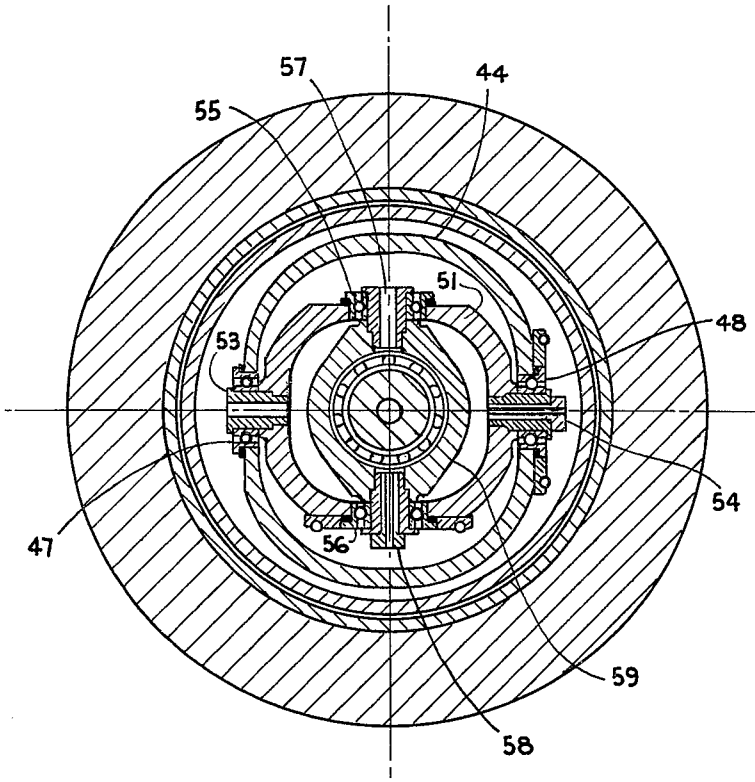
FIG. 7 is a cross-sectional view taken along lines A — A in FIG. 6.

Referring to FIGS. 6 and 7, the gimbal mounting for rotor 28 is revealed in greater detail. The forwardmost end of gyro base 44 is revealed by FIG. 7 to be open, and to be enlarged somewhat from the circular in the vertical direction. A pair of outer bearings 47 and 48 are disposed in the forward end of the base, with short shafts 53 and 54 disposed in these bearings being responsible for suspending gimbal ring 51 in the interior of the forward portion of the gyro base.

As revealed in both FIGS. 6 and 7, a pair of inner bearings 55 and 56 are vertically disposed in upper and lower portions of the gimbal ring 51, and short members 57 and 58 through these bearings form a support for inner gimbal 59. Disposed along the centerline of the inner gimbal is an aperture through which the support shaft 32 extends, with a pair of spin bearings 61 and 62 disposed between the shaft 32 and the inner gimbal 59. It is of course apparent that these bearings form the means upon which the rotor 28, the shaft 32 and the nutation damper 31 rotate.

A threaded hollow nut 64 is disposed adjacent the rear end of the inner gimbal, which nut may be tightened to a sufficient degree to hold the outer races of bearings 61 and 62 against a shoulder on the interior of the inner gimbal, thus preventing undesirable rotative movements of these races in the interior of the inner gimbal. Disposed around the outer rear portion of the nut is an O ring 65 whose function it is to prevent metallic contact between the nut and the interior of the gyro base when the rotor spin axis is caused to move with respect to the centerline of the gyro base 44. It should be noted that the portion of the gyro base disposed in the vicinity of the nutation damper is enlarged so as to enable substantial movements of the rotating components away from the centerline extending through the gyro base. Closure of the interior of the gyro base from the rearward direction is made possible by a plate 66 which is held in position by a plurality of screws or bolts 67. An O ring 68 disposed radially inwardly from the bolt circle prevents undesirable access to the interior of the gyro base when the plate is in position.

FIGS. 6 and 7 also reveal that the forward end of the support shaft 32 is internally threaded along its centerline, into which is threaded a screw 71, the head of which is large enough to engage the hub portion of the gyro wheel 28 and to prevent the gyro wheel from becoming loose with respect to the shaft 32. It should be noted that the hub portion of the wheel 28 is elongated rearwardly, and that such portion bears upon the inner races of the spin bearings 61 and 62. Therefore, upon the screw 71 being tightened, this causes the inner races of the bearings to be held between the hub portion of the wheel and a shoulder 72 on support shaft 32, thus to prevent undesirable rotation of the inner races with respect to the shaft.

Figure 8:
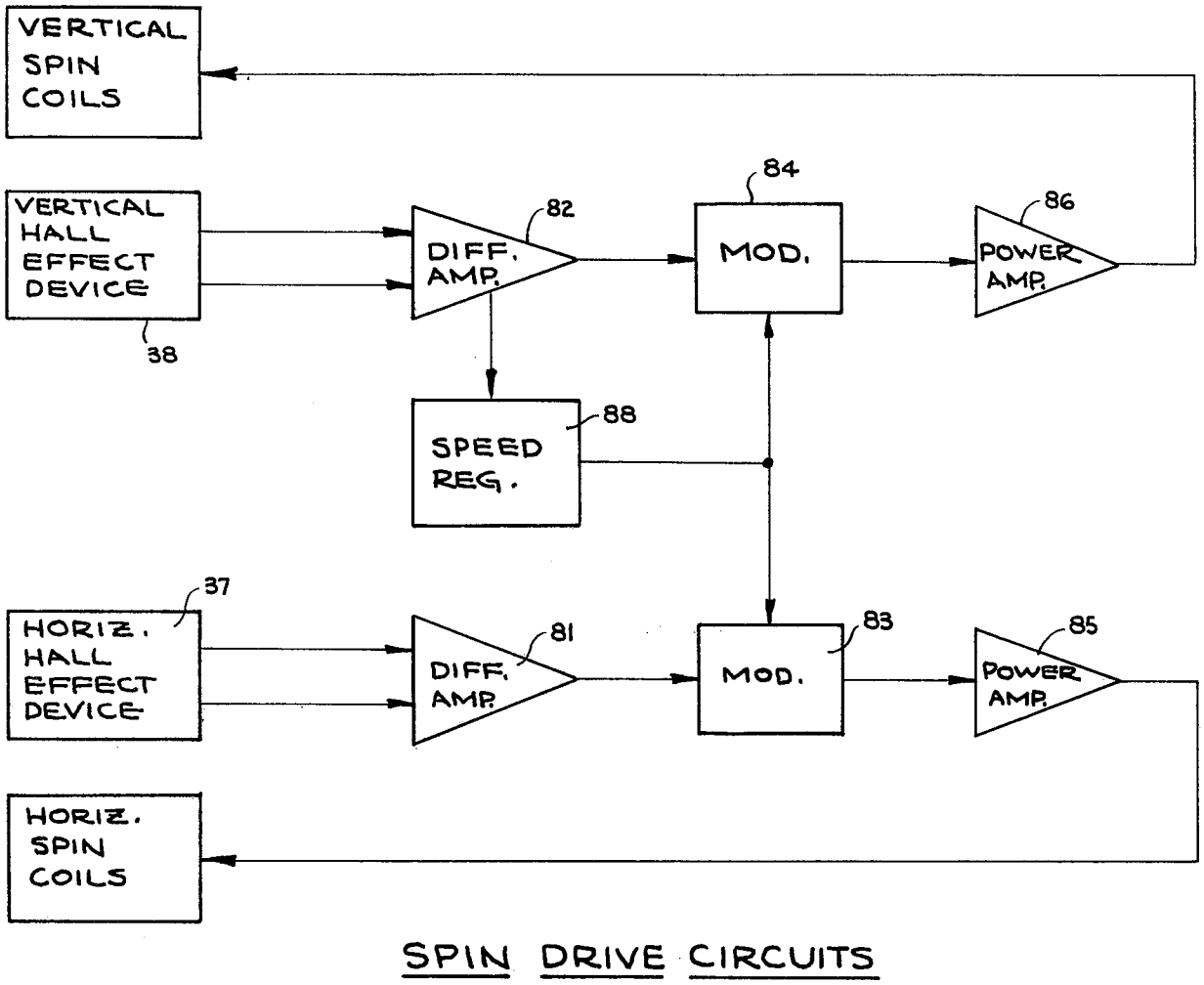
FIG. 8 is a block diagram of the Spin Drive Circuits.

Turning to FIG. 8, it will there be noted that I have set forth the Spin Drive Circuits in block diagram form. In this figure the horizontal Hall effect drive 37 is shown connected to differential amplifier 81, and vertical Hall effect 38 is depicted connected to differential amplifier 82. These Hall devices are in effect bridge circuits whose imbalance is proportional to the magnitude and direction of the magnetic flux passing through them. The outputs from the differential amplifiers 81 and 82 are then connected to modulator circuits 83 and 84, respectively, which devices control the amplitude of the output signals. The signals are then amplified in power amplifiers 85 and 86, respectively, to generate a current which flows through the associated spin coils shown in detail in FIGS. 3 and 4, thus producing a spin torque that causes the rotation of the rotor.

The speed control circuit utilizes a speed regulator 88 which contains an oscillator which frequency is compared to the output of the Hall effect devices, which is of course the spin frequency, When the frequency of this oscillator is lower than that of the spin frequency, the amplification of the input to the modulator circuit is reduced until the frequency of the regulating oscillator and the spin speed of the magnetic rotor are synchronized. On the other hand, when the frequency of the regulating oscillator is higher than the frequency resulting from the change in flux through the Hall effect devices, the foregoing procedure is reversed.

As will be apparent to those skilled in this art, as a result of the arrangement shown in FIG. 8, the rotor can be brought from a standing start rapidly up to a predetermined speed and maintained stably at that speed. However, this arrangement is not regarded by me as being patentable.

Figure 9:
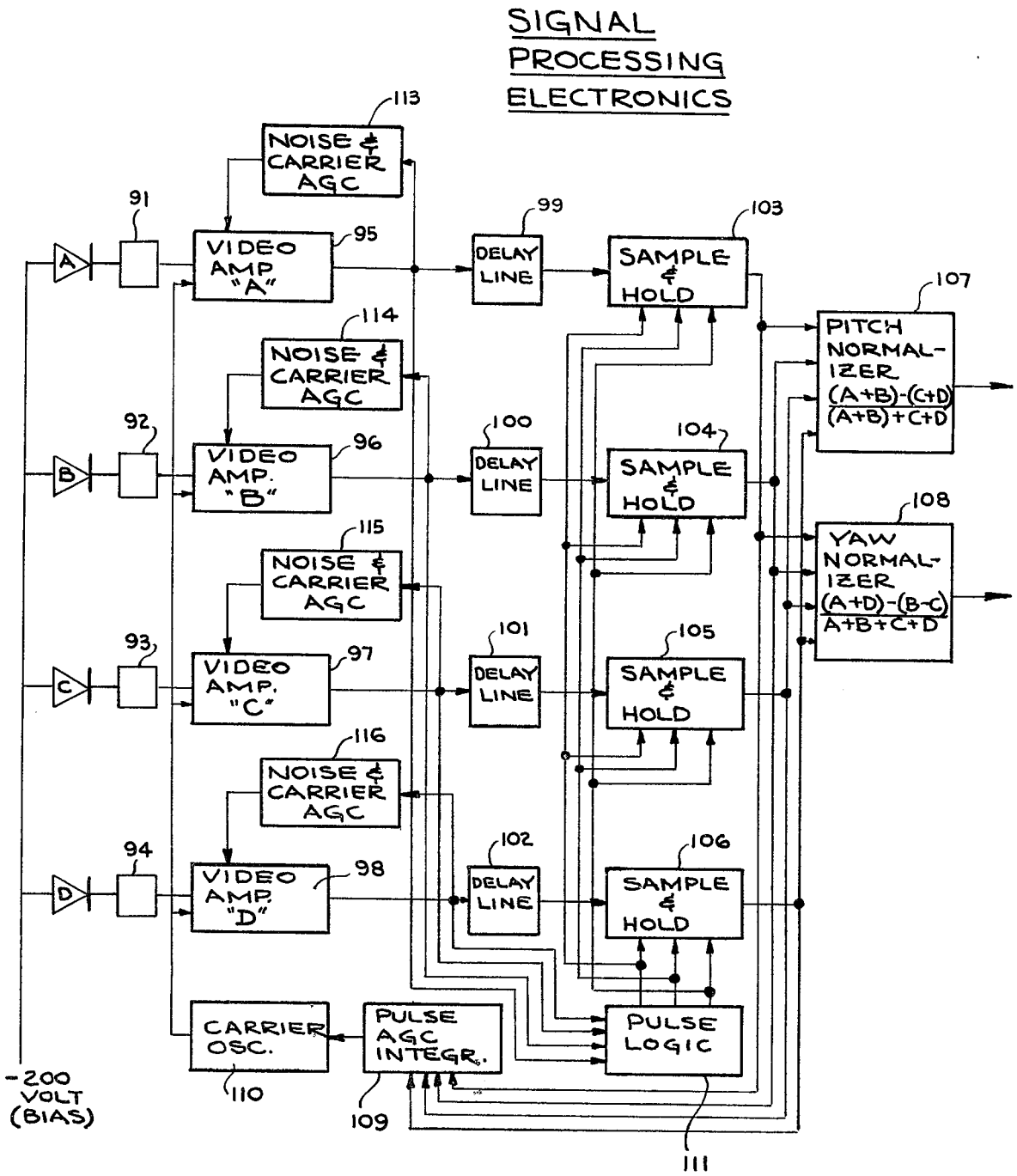
FIG. 9 is a block diagram of the Signal Processing Electronics.

Turning to FIG. 9, it will be noted that I have there shown the Signal Processing Electronics, these components serving to convert the electromagnetic energy falling on the sensitive elements or cells of the multielement detector into appropriate commands. Inasmuch as the preferred embodiment of the detector means involves a quadrant detector I have illustrated the Signal Processing Electronics in conjunction with components associated with four sensitive components, with the electromagnetic energy falling on the quadrants A, B, C and D of the quadrant detector being converted into appropriate pitch and yaw steering commands. These four cells are of course associated with the preferred form of quadrant detector in which the cells are grouped together to form the sensitive portion 22 of the detector 23 as shown in FIG. 2.

Electrically, the arrangement is such that the energy falling upon each quadrant is preamplified by respective preamplifiers 91, 92, 93 and 94. The outputs from these preamplifiers are respectively connected to video amplifiers 95, 96, 97 and 98. The outputs from the video amplifiers connect to respective delay lines 99, 101, and 102 as well as to pulse logic circuit 111. In the pulse logic circuit, certain amplitude tests are made to determine the validity of the incident pulse, e.g., to separate the desired reflected signal from noise inputs.

Although, as just pointed out, in the preferred embodiment of my invention, the multielement detector is a quadrant detector, it is well within the scope of my invention for the multielement detector to utilize detectors having three sensitive elements, or even a larger number, such as eight sensitive elements. In the event a three element detector is utilized, it would have three 120° pie shaped segments utilized in conjunction with comparable steering commands. This arrangement would of course be particularly useful in conjunction with the guidance of a three fin missile. The use of a larger number of sensitive elements than three or four will quite understandbly enable finer radial definition of the steering command to be provided.

In the preferred embodiment, the detector means is fixed in the housing with energy being directed toward such detector by a mirror, which is a portion of the stabilized element. This is not inconsistent with an implementation of my invention using an arrangement in which the detector means is mounted on or in the stabilized element. Also, electrical coils are preferably used to generate the torques necessary to spin the stabilized element, but in some instances I may use a spring wound energy source which might be used to spin the inertial element long enough for a missile flight.

Returning to the circuitry of FIG. 9, when the pulse logic circuitry requirements are met, for sample and hold circuits, 103 through 106, are enabled, these circuits of course being connected to accept the pulses arriving from the four delay lines 99, 100, 101 and 102, respectively. The sample and hold circuits maintain the pulse level constant until a succeeding pulse arives, at which time the entire process is repeated. It should be noted that the outputs from the sample and hold circuits are connected to the pitch normalizer circuit 107, the yaw normalizer circuit 108, and to a pulse automatic gain control integrator circuit 109.

In the pitch and yaw normalizer circuits certain mathematical operations are performed to generate signals proportional to the pitch error and the yaw error, these errors of course being relatable to the distance between the center of received energy falling upon the detector cell, and the center of the sensitive portion of the detector cell. It will be noted that the mathematical operations performed are actually depicted in pitch normalizer block 107 and yaw normalizer 108.

The output of the pulse automatic gain control integrator 109 controls the amplitude of carrier 110, which in turn controls the gain of the four video amplifiers 95, 96, 97 and 98.

The gain of these video amplifiers, in the absence of a received signal and a corresponding output from the carrier oscillator 110, is controlled by four noise and carrier automatic gain control circuits 113, 114, 115, and 116, which connect to the video amplifier 95 through 98, respectively.

The outputs from the Signal Processing Electronics are of course the outputs from pitch normalizer 107 and yaw normalizer 108, which are amplified and sent to the autopilot or to the appropriate location to serve as steering commands for the vehicle.

Displacement of the spinning mirror on its gimbals or displacement of the case around the gyroscopically stabilized spinning mirror will cause the rotating flux field of the permanent magnet rotor to intersect the turns of the coaxially wound torquing or processing coil. This will result in an electromotive force being generated in the coil and a current flow through the coil and its terminating impedance. The amplitude of this current will be proportional to the amplitude of the gimbal angle rotation and the phase of this current when compared to the position of the rotating magnet will be displaced 90° from the gimbal angle rotation. The average torque impressed on the seeker rotor by the magnetic field resulting from the torquing coil current will cause the rotor to precess in the direction of zero gimbal displacement. The result of this arrangement is in effect a gyroscope in which the rotor is automatically precessed to align itself with its case. The precession rate is directly proportional to the magnitude of the gimbal angle between rotor and case and inversely proportional to the magnitude of the torquing coil terminating impedance. In the preferred embodiment the torquing coil terminating impedance is chosen to produce a precession rate of approximately 0.333 degrees per second per degree of gimbal angle displacement.

It should now be apparent that I have provided a novel seeker usable for the guidance of vehicles, or stated differently, I have provided a new class of seekers usable to implement homing guidance. A guidance system provided in accordance with this invention may be utilized with any of a number of different vehicles, which would utilize a gyro stabilizer seeker arranged in such a manner with respect to the vehicle as not to be servo controlled, but rather to follow the vehicle airframe by means of passive coupling between seeker and airframe, as the airframe is steered to turn in response to seeker error signals. As a result of this arrangement, the vehicle velocity vector is steered to point toward fixed targets or to lead moving targets. A further result of this arrangement is that the usual servo loop used to point the seeker toward the target in the conventional arrangement is not required, and accordingly my guidance arrangement can achieve greater accuracy with less complexity and expense than previously possible.

The preferred embodiment of my invention was of course described in connection with light energy, and such may for example be laser energy reflected from the target when illuminated by a laser illuminator coordinated with the launching vehicle.

However, I am not to be so limited, and my device could well be sensitive to an entirely different form of energy, such as radar energy, in which case the seeker would include a small radar antenna. The preferred embodiment was also described in conjunction with a multielement detector that is quadrant shaped, but those skilled in this art will quickly recognize that the multielement detector could have three sensitive elements, or even a substantially larger number, even to include the large number of detection elements disposed on the face of a vidicon tube. Further, if the vehicle were a torpedo, for example, the detector could be an acoustical device. The coupling means could be viscous fluid operatively located between the inertially stabilized element and the housing.

The implementation of this guidance system results in steering laws which are different from those of prior art devices because although compensation herein is provided for errors induced by target motion or cross wind, no attempt need be made here to measure line of sight rotation rate, which is basic to the PNG guidance system techniques of the prior art in order to compensate for these error sources.

1. An inertially stabilized seeker comprising a housing, a stabilized seeker element operatively disposed in said housing, and passive coupling means in said seeker functioning to cause said seeker element to move to orient itself with said housing, such movements taking place at a rate proportional to any displacement angle between the seeker element axis and the housing axis.

2. The inertially stabilized seeker as defined in claim 1 in which multielement detector means sensitive to radiation is disposed in said housing, with any relative movements taking place between said seeker element axis and the direction of the source of such radiation changing the output of said detector means.

3. The seeker as defined in claim 2 in which said seeker is usable in a vehicle whose direction of motion can be changed, the output of said detector means being utilized to change the direction of such vehicle motion and hence the orientation of said housing.

4. The seeker as defined in claim 3 in which said passive coupling means involves the use of a spinning magnet and a fixed coil.

5. The seeker as defined in claim 3 in which said passive coupling means involves the use of a viscous fluid between said stabilized seeker element and said housing.

6. The seeker as defined in claim 3 in which said multielement detector means is a quadrant detector.

7. The seeker as defined in claim 3 in which said detector means involves a plurality of photosensitive diodes.

8. The seeker as defined in claim 3 in which said multielement detector means is a vidicon tube.

9. The seeker as defined in claim 3 in which said means for receiving incoming radiation is a radar antenna mounted on said inertially stabilized element.

10. The seeker as defined in claim 3 in which said means for receiving incoming radiation is an acoustic device.

11. An inertially stabilized seeker comprising a housing, a stabilized seeker element operatively disposed in said housing, passive coupling means disposed in said housing and arranged to cause said stabilized element to orient itself in a preferred position with said housing, the inertial turn rate of said stabilized element toward such preferred position in said housing being proportional to the displacement angle between the seeker element and such preferred position, said seeker being disposable in a missile and arranged to guide the missile to a source fo electromagnetic energy.

12. A seeker for guiding a vehicle to a source of electromagnetic radiation comprising a housing, a detector disposed in said housing, means for admitting electromagnetic radiation into said housing, so that it can fall upon said detector and be detected, an inertially stabilized element operatively disposed in said housing, and normally maintained in a preferred alignment with the axis of said housing, said inertially stabilized element having means for controlling the manner and direction in which electromagnetic energy falls upon said detector, the output from said detector being used to supply control signals for moving the path of travel of the vehicle and hence the axis of said housing toward the source of radiation, and passive coupling means for causing said inertial element to tend to move to orient itself in the preferred direction with respect to said housing, such motion taking place at a rate proportional to the displacement angle between the axis of said element and the axis of said housing.

13. The seeker as defined in claim 12 in which said means for admitting incoming electromagnetic radiation includes a lens and a filter, and said means for controlling electromagnetic energy is a mirror.

14. The seeker as defined in claim 12 in which said detector is a multielement detector.

15. The seeker as defined in claim 12 in which said detector is a vidicon.

16. The seeker as defined in claim 12 in which said means for receiving incoming radiation is a radar antenna mounted on said inertially stabilized element.

17. A seeker usable in a vehicle, said seeker being arranged for sense the presence of electromagnetic energy as well as the direction of the source of such electromagnetic energy, said seeker comprising a housing, an inertially stabilized element operatively mounted in said housing, passive coupling means for controlling the positioning of said inertially stabilized element with respect to said housing, means for receiving incoming electromagnetic radiation when the axis of said housing is disposed in a pre-established direction with respect to said source, means on said inertially stabilized element for directing electromagnetic energy arriving from such source onto detector means, signal processing circuitry being arranged to receive energy from said detector means, and to convert it into the required directional information necessary for moving the direction of travel of such vehicle and consequently the axis of said housing in the direction of such source of electromagnetic energy, said coupling means functioning to cause said inertially stabilized element to tend to move to orient itself in a preferred direction with respect to said housing, such motion of said inertially stabilized element taking place at a rate proportional to the displacement angle between the axis of said element and the housing axis.

18. The seeker as defined in claim 17 in which said detector means is a multielement detector.

19. The seeker as defined in claim 18 in which said multielement detector utilizes three sensitive elements.

20. The seeker as defined in claim 18 in which said multielement detector has four elements, latter elements being utilized in the evolution of appropriate pitch and yaw steering commands for the vehicle.

21. An inertially stabilized seeker comprising a housing, a stabilizer seeker element operatively disposed in said housing, coupling means in said seeker functioning to cause said seeker element to move to orient itself with said housing, such movements taking place at a rate proportional to any displacement angle between the seeker element axis and the housing axis, and multielement detector means, sensitive to radiation, being disposed in said housing, with any relative movements taking place between said seeker element axis and the direction of the source of such radiation changing the output of said detector means, said seeker being usable in a vehicle whose direction of motion can be changed, with the output of said detector means being utilized to change the direction of such vehicle motion and hence the orientation of said housing.

22. A seeker for guiding a vehicle to a source of electromagnetic radiation comprising a housing, a multielement detector disposed in said housing, means for admitting electromagnetic radiation into said housing, so that it can fall upon said detector and be detected, an inertially stabilized element operatively disposed in said housing, and normally maintained in a preferred alignment with the axis of said housing, said inertially stabilized element having means for controlling the manner and direction in which electromagnetic energy falls upon said detector, the output from said detector being used to supply control signals for moving the path of travel of the vehicle and hence the axis of said housing toward the source of radiation, and coupling means for causing said inertial element to tend to move to orient itself in the preferred direction with respect to said housing, such motion taking place at a rate proportional to the displacement angle between the axis of said element and the axis of said housing.

23. The seeker as defined in claim 22 in which said multielement detector utilizes a plurality of photosensitive diodes.

24. The seeker as defined in claim 23 in which said diodes are employed in a quadrant arrangement.

25. An inertially stabilized seeker comprising a housing adapted to encounter motion in inertial space, a stabilized seeker element operatively disposed in said housing, said housing and said seeker element each having an axis, passive coupling means for causing the axis of said stabilized seeker element to move to maintain orientation with the axis of said housing, the rate of motion of said seeker element in inertial space generated by said coupling means being proportional to the angular displacement between the stabilized axis of said seeker element and the axis of said housing, and multielement detector means disposed in said housing, said detector means having an input sensitive to electromagnetic radiation, and also having an output, said detector means serving to detect angular errors between the stable axis of said seeker element and a source of electromagnetic radiation, the output provided by said detector means being available for steering a vehicle toward such source of electromagnetic radiation.

26. The seeker as defined in claim 25 in which said seeker housing is lightly coupled to the frame of the vehicle.

* * * * *